US005624043A

United States Patent [19]

Baptista

[11] Patent Number: 5,624,043

[45] Date of Patent: Apr. 29, 1997

[54] WINE BOTTLE SUPPORTING AND SERVING TRAY

[76] Inventor: Nelson L. Baptista, 204 Dovercourt Road, Apt. 102, Toronto, Ontario, Canada, M6J-3C8

[21] Appl. No.: 617,570

[22] Filed: Mar. 19, 1996

[51] Int. Cl.[6] ..... A47F 7/00

[52] U.S. Cl. ..... 211/74; 211/60.1; 248/105; 248/311.2; 248/312; D7/701

[58] Field of Search ..... 211/74, 60.1; 248/105, 248/311.2, 312; D7/701

[56] References Cited

U.S. PATENT DOCUMENTS

| | | | |
|---|---|---|---|
| 2,527,796 | 10/1950 | Clute | 211/74 |
| 3,814,293 | 6/1974 | Daves | 248/105 X |
| 4,496,124 | 1/1985 | Cole | 211/74 X |
| 4,515,334 | 5/1985 | Horne | 211/74 X |
| 5,197,612 | 3/1993 | Thomson | 211/74 |
| 5,558,236 | 9/1996 | Williams et al. | 211/74 |

FOREIGN PATENT DOCUMENTS

| | | | |
|---|---|---|---|
| 2244204 | 11/1991 | United Kingdom | 211/74 |

*Primary Examiner*—Robert W. Gibson, Jr.

[57] ABSTRACT

The present invention relates to a device which is adapted to support a wine bottle in one of two orientations. In its broadest context, the present invention includes a base with two upwardly extending side walls. The first side wall is a display stand and has an aperture formed within its length. The second side wall is a serving stand and has a semicircular recess formed upon its upper edge.

4 Claims, 3 Drawing Sheets

FIG 3
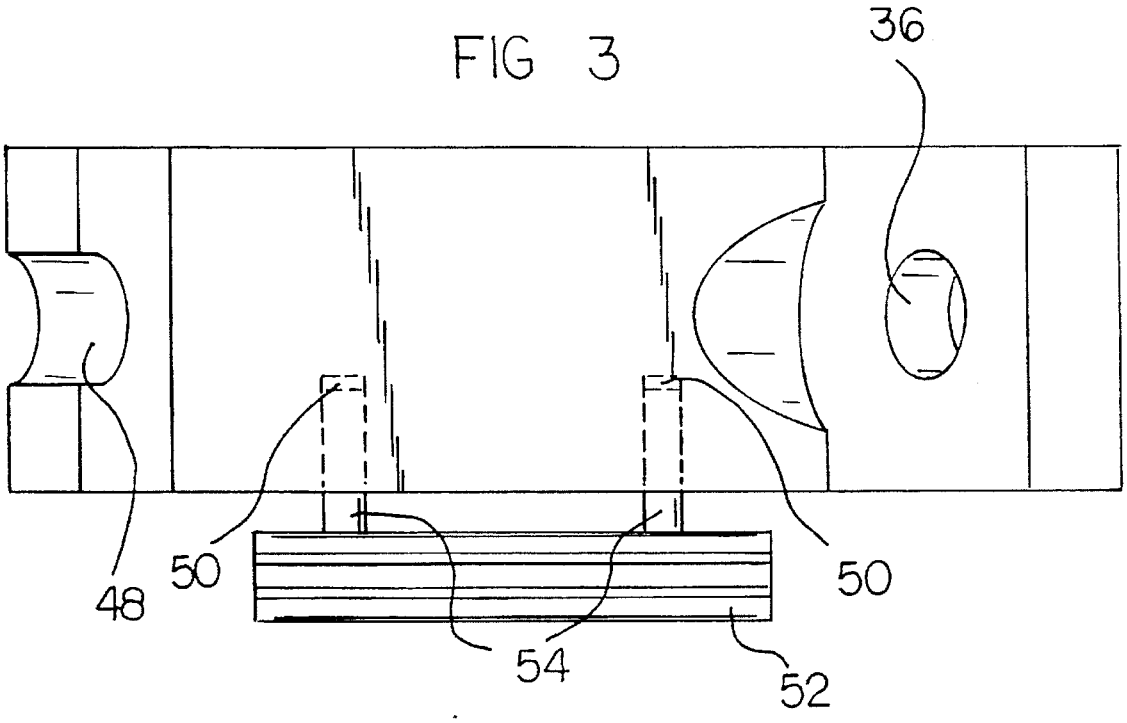
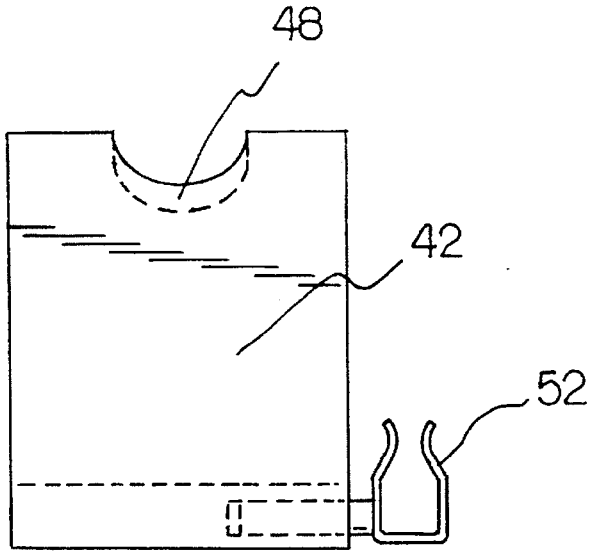
FIG 4

WINE BOTTLE SUPPORTING AND SERVING TRAY

BACKGROUND OF THE INVENTION

1. Field of the Invention

The present invention relates to a wine bottle supporting and serving tray and, more particularly, pertains to a device for supporting a bottle in one of two orientations.

2. Description of the Prior Art

The use of wine bottle holders are known in the prior art. More specifically, wine bottle holders heretofore devised and utilized for the purpose of device for supporting wine bottles are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 5,180,066 to McArdle; U.S. Pat. No. Des. 329,781 to Ito; U.S. Pat. No. Des. 252,065 to Leventhal; and U.S. Pat. No. Des. 307,373 to Bearak each disclose wine bottle display racks and/or holders. Furthermore, U.S. Pat. No. 5,248,048 to Dore discloses a wine selling and merchandising holder. Lastly, U.S. Pat. No. 5,301,857 to Green discloses a bottle holder with bottle neck grip and logo.

In this respect, the wine bottle supporting and serving tray according to the present invention substantially departs from the conventional concepts and designs of the prior art, and in so doing provides an apparatus primarily developed for the purpose of device for supporting a bottle in one of two orientations.

Therefore, it can be appreciated that there exists a continuing need for new and improved wine bottle supporting and serving tray which can be used for device for supporting a bottle in one of two orientations. In this regard, the present invention substantially fulfills this need.

SUMMARY OF THE INVENTION

In view of the foregoing disadvantages inherent in the known types of wine bottle holders now present in the prior art, the present invention provides an improved wine bottle supporting and serving tray. As such, the general purpose of the present invention, which will be described subsequently in greater detail, is to provide a new and improved wine bottle supporting and serving tray apparatus and method which has all the advantages of the prior art and none of the disadvantages.

To attain this, the present invention essentially comprises a wine bottle supporting and serving tray, comprising, in combination, a wooden base having a lower surface, an upper surface and a peripheral edge therebetween. The base further includes a first end and a second end. A depression is formed upon the upper surface of the first end. The depression has a straight edge along the first end of the base and a curved edge opposite the straight edge. A wooden display stand has a lower end, an upper end, an interior surface and an exterior surface. The lower end is integral with the first end of the base and extending upwardly at a 45 degree angle relative to the base. A circular aperture is formed in the display stand intermediate the upper and lower ends. The circular aperture has an upper half and a lower half. A bevel is formed adjacent the lower half of the circular aperture within the interior surface. A wooden serving stand has a lower end and an upper end and a top edge, an interior surface and an exterior surface. The serving stand extends upwardly at an angle of 30 degrees relative to the base. The lower end of the serving stand is integral with the base. A semi-circular recess is formed within the top edge of the serving stand. A pair of apertures are formed within the peripheral edge of the base. A napkin clip has an open upper end and a closed lower end. The napkin clip functions to receive a napkin. A pair of dowels are secured to the napkin clip. The dowels are secured within the apertures of the base.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wine bottle supporting and serving tray which has all the advantages of the prior art wine bottle holders and none of the disadvantages.

It is another object of the present invention to provide a new and improved wine bottle supporting and serving tray which may be easily and efficiently manufactured and marketed.

It is a further object of the present invention to provide a new and improved wine bottle supporting and serving tray which is of a durable and reliable construction.

An even further object of the present invention is to provide a new and improved wine bottle supporting and serving tray which is susceptible of a low cost of manufacture with regard to both materials and labor, and which accordingly is then susceptible of low prices of sale to the consuming public, thereby making such wine bottle holders economically available to the buying public.

Still yet another object of the present invention is to provide a new and improved wine bottle supporting and serving tray which provides in the apparatuses and methods of the prior art some of the advantages thereof, while simultaneously overcoming some of the disadvantages normally associated therewith.

Still another object of the present invention is to device for supporting a bottle in one of two orientations.

Lastly, it is an object of the present invention to provide a device which is adapted to support a wine bottle in one of two orientations. In its broadest context, the present invention includes a base with two upwardly extending side walls. The first side wall is a display stand and has an aperture formed within its length. The second side wall is a serving stand and has a semicircular recess formed upon its upper edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the tray and associated napkin clip.

FIG. 4 is an elevational view of the tray and associated napkin clip in accordance with the present invention.

Similar reference characters refer to similar parts throughout the several views of the drawings.

DESCRIPTION OF THE PREFERRED EMBODIMENT

Figure 1:
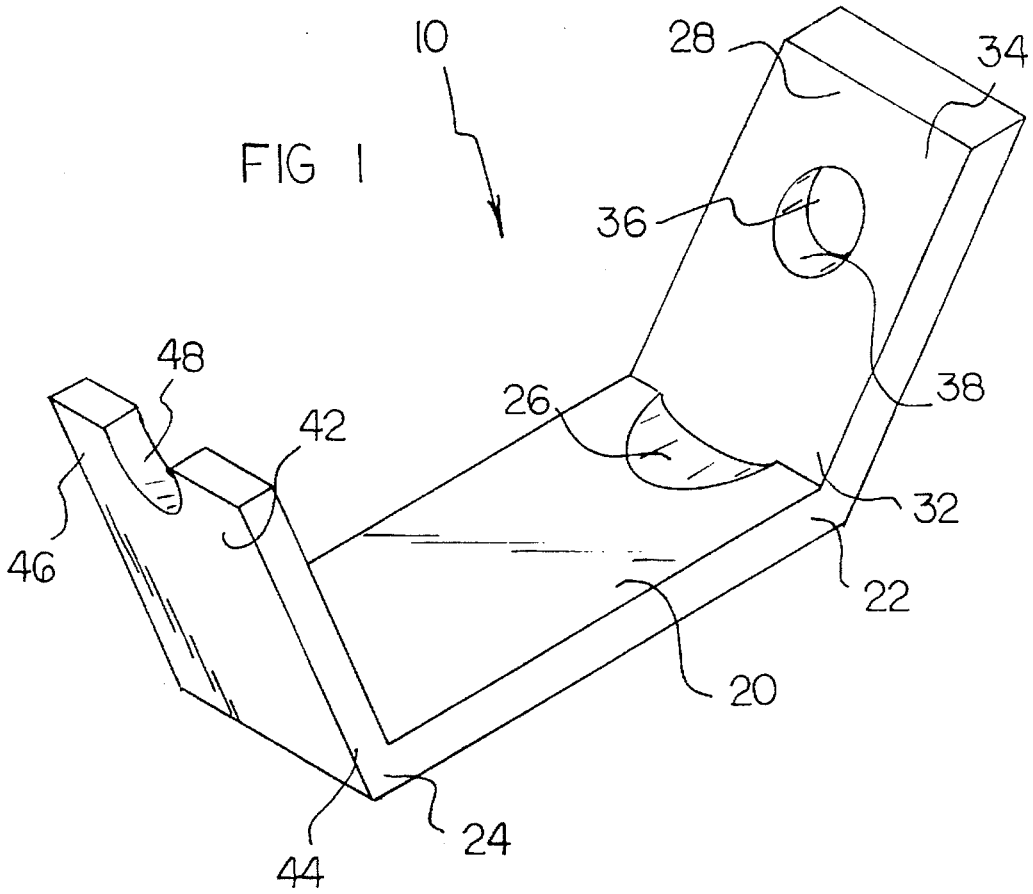
FIG. 1 is a perspective illustration of the tray in accordance with the present invention.
Figure 2:
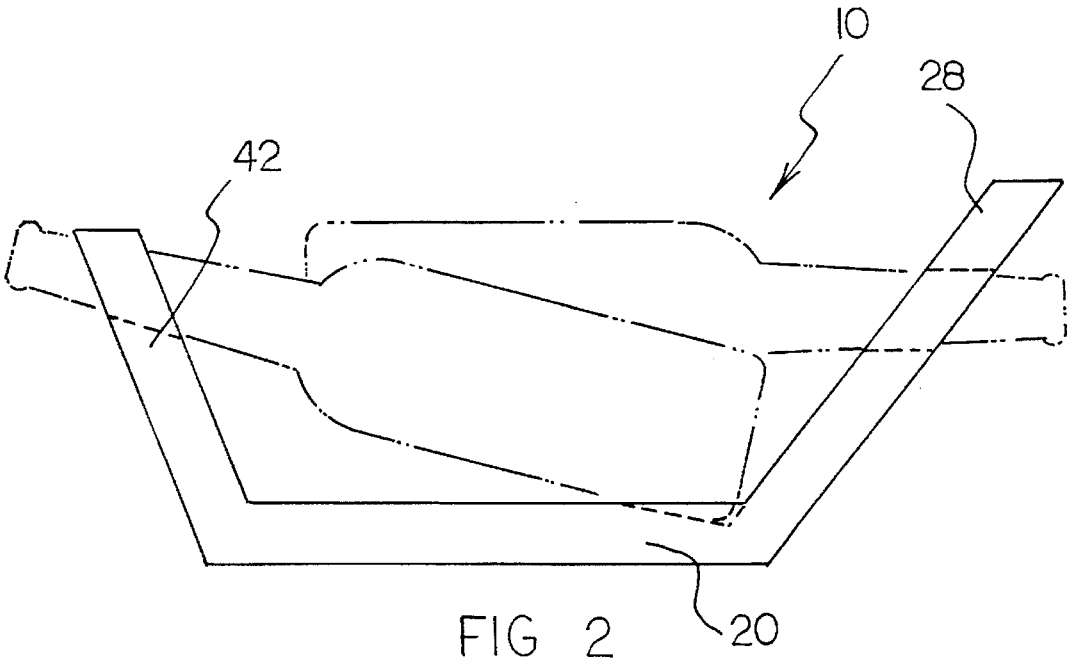
FIG. 2 is a side view of the tray in accordance with the present invention.
Figure 5:
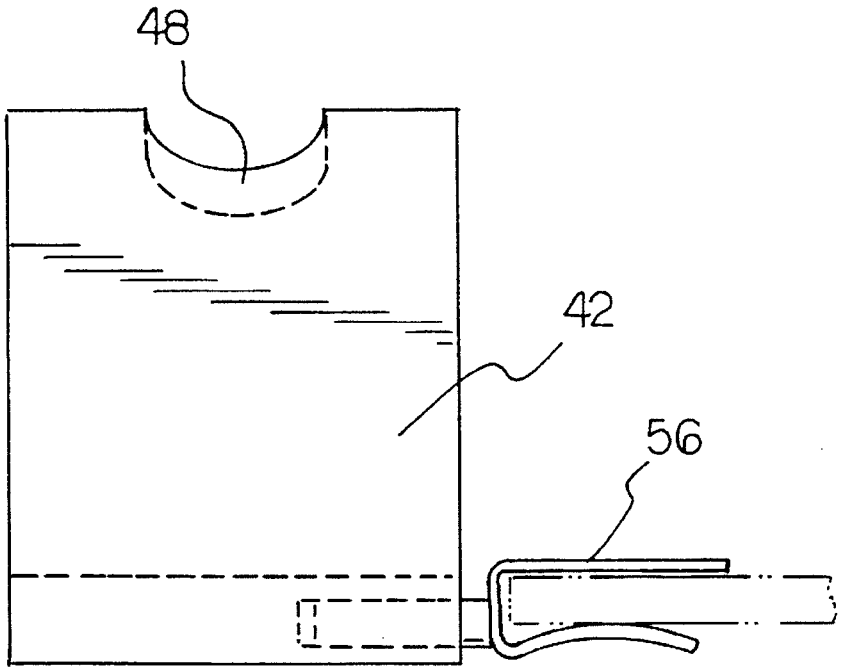
FIG. 5 is an elevational view of the tray and table clip in accordance with the present invention.

With reference now to the drawings, and in particular to FIG. 1 thereof, a new and improved wine bottle supporting and serving tray embodying the principles and concepts of the present invention and generally designated by the reference numeral 10 will be described.

The present invention relates to a device which is adapted to support a wine bottle in one of two orientations. In its broadest context, the present invention includes a base with two upwardly extending side walls. The first side wall is a display stand and has an aperture formed within its length. The second side wall is a serving stand and has a semicircular recess formed upon its upper edge.

The base 20 of the device 10 is defined by a lower surface, an upper surface and a peripheral edge which extends therebetween. The base 20 is further defined by a first end 22 and a second end 24. Furthermore, a depression 26 is formed upon the upper surface of the first end 22 of the base 20. This depression, which can most clearly be seen in FIG. 1, has a straight edge along the first end of the base and a curved edge opposite the straight edge. This depression is for use in receiving the bottom of a wine bottle when it is being stored in the serving orientation.

The device 10 further include is a display stand 28 which is defined by a lower end 32 and an upper end 34 as well as by an interior surface and an exterior surface. The lower end 32 of the stand 28 is integral with the first end 22 of the base 20. More specifically, the display stand extends upwardly at a 45 degree angle relative to the base 20. Furthermore, a circular aperture 36 is formed through the display stand 28 intermediate the upper and lower ends 32 and 34. This circular aperture 36 is defined by an upper half and a lower half. Furthermore, a bevel 38 is formed adjacent the lower half of the circular aperture 36 within the interior surface. The display stand 28 is employed when storing a wine bottle in a display orientation. More specifically, the neck of a wine bottle is adapted to be received within the circular aperture 36. The bevel 38 is included to insure a more secure fit of the neck of the wine bottle within the circular aperture 36. In this orientation, the wine bottle is suspended above the base 20 and is essentially cantilevered with respect to the display stand 28. This is the display orientation.

The device 10 further includes a serving stand 42 which is defined by a lower end 44 and an upper end 46. The serving stand 42 is further defined by a interior surface and an exterior surface. Furthermore, the serving stand 42 extends upwardly at an angle 30 degrees relative to the base, with the lower end 32 of the serving stand 42 being integral with the base 20. Furthermore, a semicircular recess 48 is formed within the top edge of the serving stand. This semicircular recess can most clearly be seen in FIG. 1. The serving stand 42 is employed in supporting a wine bottle in its serving orientation. More specifically, the bottle is supported such that the neck of the bottle rests within the semicircular recess while the bottom of the bottle is supported within the depression 26. In this orientation, the bottle can be readily removed from the device 10, or in the alternative, wine can be poured from the bottle while it is within the device and in the serving orientation. The base 20, display stand 28 and serving stand 42 as described above, are preferably constructed from a wood material.

Figure 6:
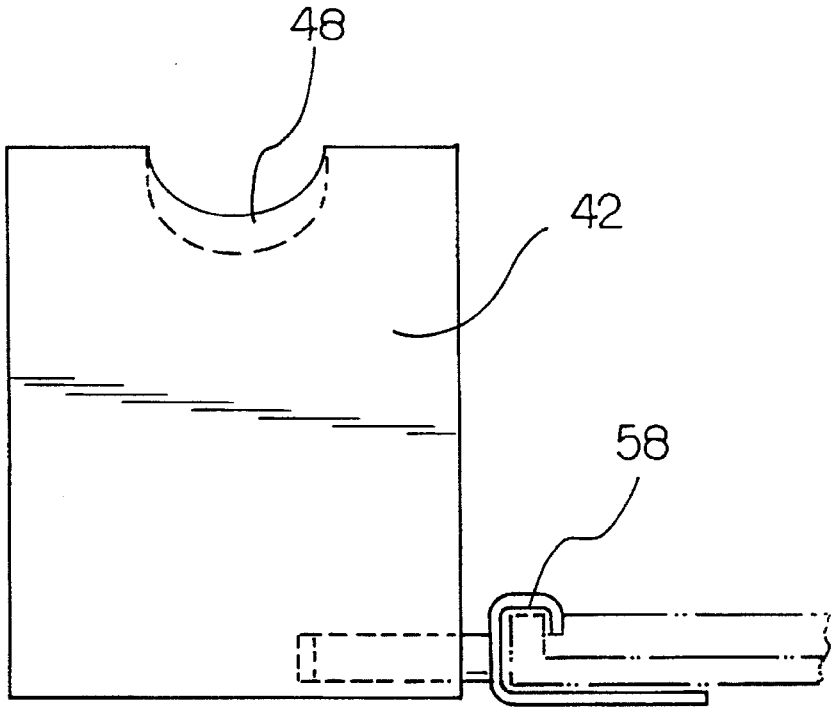
FIG. 6 is an elevational view of the tray and associated tray clip in accordance with the present invention.

In an alternative embodiment, a pair of apertures 50 are formed in the peripheral edge of the base. The function of these apertures will be described in greater detail hereinafter. Furthermore, a napkin clip 52 which is defined by an open upper end and a closed lower end includes a pair of dowels 54 extending from its side. These dowels are adapted to be secured within the apertures 50 of the base. In this manner, the napkin clip 52 can be secured to the side of the device 10 by way of the dowels 54 and apertures 50. Thus, the user has a means by which to position a napkin adjacent the device. More specifically, a napkin can be secured within the open upper end of the napkin clip 52, with the napkin clip secured to the device 10 by way of the dowels and apertures. Alternatively, a table clip 56 can be secured to one of the apertures of the base while an additional table clip 56 can be secured to the remaining aperture of the base. In this manner, two table clips 56 are individually secured to the side of the device 10 by way of the dowels and apertures. With this embodiment, the device 10 of the present invention can be secured to the side of a table. Furthermore, a tray clip 58 can be used in place of the table clip 56. The tray clip as depicted in FIG. 6 includes an upper edge which is closed. This enables the device 10 to be secured to a tray or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wine bottle supporting and serving tray, comprising, in combination:

a wooden base having a lower surface, an upper surface and a peripheral edge therebetween, the base further including a first end and a second end, a depression formed upon the upper surface of the first end, the depression having a straight edge along the first end of the base and a curved edge opposite the straight edge;

a wooden display stand having a lower end, an upper end, an interior surface and an exterior surface, the lower end being integral with the first end of the base and extending upwardly at a 45 degree angle relative to the base, a circular aperture formed in the display stand intermediate the upper and lower ends, the circular aperture having an upper half and a lower half, a bevel formed adjacent the lower half of the circular aperture within the interior surface;

a wooden serving stand having a lower end and an upper end and a top edge, an interior surface and an exterior surface, the serving stand extending upwardly at an angle of 30 degrees relative to the base, the lower end of the serving stand being integral with the base, a semi-circular recess formed within the top edge of the serving stand;

a pair of apertures formed within the peripheral edge of the base; and a napkin clip having an open upper end and a closed lower end, the napkin clip functioning to receive a napkin, a pair of dowels secured to the napkin clip, the dowels secured within the apertures of the base.

2. A wine bottle supporting and serving tray, comprising:

a base having a lower surface, an upper surface and a peripheral edge therebetween, the base further including a first end and a second end, a depression formed upon the upper surface of the first end, the depression having a straight edge along the first end of the base and a curved edge opposite the straight edge;

a display stand having a lower end, an upper end, an interior surface and an exterior surface, a circular aperture formed to the display stand intermediate the upper and lower ends, the circular aperture having an upper half and a lower half, a bevel formed adjacent the lower half of the circular aperture within the interior surface; and a serving stand having a lower end and an upper end and a top edge, an interior surface and an exterior surface, the lower end of the serving stand being integral with the base, a semi-circular recess formed within the top edge of the serving stand.

3. The device as set forth in claim 2 wherein the lower end of the display is integral with the first end of the base and extending upwardly at a 45 degree angle relative to the base and the serving stand extends upwardly at an angle of 30 degrees relative to the base.

4. The device as set forth in claim 2 and further including a pair of apertures formed within the peripheral edge of the base and a napkin clip having an open upper end and a closed lower end, the napkin clip functioning to receive a napkin, a pair of dowels secured to the napkin clip, the dowels secured within the apertures of the base.

* * * * *